US006145525A

United States Patent [19]

Mooney

[11] Patent Number: 6,145,525

[45] **Date of Patent: *Nov. 14, 2000**

[54] APPARATUS AND METHOD FOR CABINET MOUNTED TENT

[75] Inventor: David Allan Mooney, Chateauguay, Canada

[73] Assignee: T.A. Pelsue Company, Englewood, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/692,365

[22] Filed: Aug. 6, 1996

[51] Int. Cl.[7] ..... E04H 15/64

[52] U.S. Cl. ..... 135/119; 52/63; 52/586.1; 52/745.13; 52/DIG. 12; 135/120.3; 135/900; 160/47

[58] Field of Search ..... 52/63, DIG. 12, 52/27, 222, 586.1, 745.13; 135/88.12, 90, 95, 96, 97, 116, 117, 119, 120.1, 120.3, 137, 88.1, 88.17, 88.18, 147, 161, 900; 160/47, 368.1, 392, 395; 312/4

[56] References Cited

U.S. PATENT DOCUMENTS

| | | | |
|---|---|---|---|
| 2,255,837 | 9/1941 | Volk | 135/97 |
| 2,787,321 | 4/1957 | Dietz | 160/47 |
| 2,808,065 | 10/1957 | Ellis | 135/88.1 X |
| 2,875,824 | 3/1959 | Rice | 160/392 X |
| 3,834,400 | 9/1974 | Sattler | 135/161 X |
| 3,925,828 | 12/1975 | Kim | 135/96 X |
| 3,968,809 | 7/1976 | Beavers . | |
| 4,065,166 | 12/1977 | Shoemaker | 135/117 X |
| 4,102,353 | 7/1978 | Pugliese | 135/120.3 X |
| 4,145,855 | 3/1979 | Sheldon | 52/DIG. 12 X |
| 4,285,354 | 8/1981 | Beavers . | |
| 4,398,376 | 8/1983 | Fraioli | 52/222 X |
| 4,561,227 | 12/1985 | Austin | 135/120.3 |
| 4,637,748 | 1/1987 | Beavers . | |
| 4,979,532 | 12/1990 | Johansson et al. | 135/119 X |
| 5,058,340 | 10/1991 | Muller | 52/63 X |
| 5,170,811 | 12/1992 | Kirk et al. | 135/96 X |
| 5,226,264 | 7/1993 | Walters | 52/63 |
| 5,394,897 | 3/1995 | Ritchey et al. | 135/119 X |
| 5,457,922 | 10/1995 | Far | 52/DIG. 12 X |

*Primary Examiner*—Carl D. Friedman
*Assistant Examiner*—Kevin D. Wilkens
*Attorney, Agent, or Firm*—Dorsey & Whitney LLP

[57] ABSTRACT

A method and apparatus for a shelter, particularly useful in servicing outdoor utility and telecommunications cabinets. A tent is detachably engageable with the cabinet through a set of flexible beads extending along tent flaps which slidably engage with a set of slotted rails mounted to the perimeter of the cabinet.

4 Claims, 3 Drawing Sheets

APPARATUS AND METHOD FOR CABINET MOUNTED TENT

FIELD OF THE INVENTION

The present invention relates to the field of tents and, in particular, to the field of a tent and method for using the same in detachable mounting to an outdoor structure such as a utility or telecommunications box or cabinet.

BACKGROUND OF THE INVENTION

In the provision of utility and telecommunications services and in other fields, small outdoor structures are often permanently installed for the purpose of housing various electronic components, such as switching, power supplies and test apparatus. These structures, commonly referred to as "cabinets" in the trade, allow service technicians to access the necessary electronic components without accessing the customer buildings served by those components. The cabinets are typically lighted and heated to maintain a desirable operating environment for the components housed in the cabinet and to provide a suitable working environment for technicians servicing these components. Thousands of such cabinets have been built and permanently installed, and many more will be built and installed in the future.

Many cabinets are of a substantial size; a common size is approximately the height of an ordinary service technician with a width equal to the height and a length somewhat longer than the width. Cabinets with a 6 feet by 8 feet footprint and a height of 6 feet are not unusual. Cabinets of this size typically have a set of double doors on one end for service access. Although these cabinets are of a substantial size, their interior is crowded with electronic components and related elements. There is generally insufficient space in the cabinet for the service technicians to place their tools and to perform their work. The service technician instead works largely from outside the cabinet. This poses several problems. Because the cabinet doors are kept open while the service work is done, the controlled environment in the cabinet interior is immediately lost and is not regained until after the work is completed and the doors are closed. This may adversely affect the performance and service of the various electronic components for which the controlled environment is designed. Further, the service technician is exposed to the weather during the time the service is performed. At a minimum, this may result in the inconvenience of working in uncomfortable temperature extremes; more serious, it may render the service impossible, or even dangerous to the technician or the equipment, due to rain, wind or other inclement weather.

One approach to this problem is to erect a temporary shelter outside the cabinet adjacent to the access doors. This approach as currently implemented in the prior art is unsatisfactory for several reasons. The temporary shelter such as a tent does not interface with the cabinet in a manner that seals out the weather. The tent or other temporary shelter may be difficult and time-consuming to erect properly, and may not be stable in the wind. These are problems of both effectiveness and safety.

The prior art describes a number of systems to erect and install tents that are convenient and stable, both in the field of recreation (such as camping), and the field of utilities (such as tents to pitch over manhole covers during service or to cover uncompleted construction projects). Some of these tents operate on the principle of flexible tent poles which define a tent wall in such a way that the poles are stably biased against a fabric sheet by driving a center "hub" through an instable intermediate position. Examples of such tents are in U.S. Pat. Nos. 3,968,809, 4,285,354 and 4,637,748, assigned to the assignee of the present patent. These prior art patents do not teach a system for temporary attachment of the tent to a cabinet.

SUMMARY OF THE INVENTION

The present invention addresses the problems described above with a tent that is detachably attachable to standard cabinets. The tent walls are defined by flexible tent poles that are stably biased against fabric sheets for quick and easy pitching. The interface between the tent and cabinet is sealed against the weather to maintain desired environmental conditions within both the tent and the cabinet which is open to the tent interior through the cabinet access doors.

The interface in the preferred embodiment is accomplished with a slotted rail mounted to the cabinet, and a flexible rubber or plastic beaded extrusion sewn to the tent fabric. The interface includes three extrusion components: one for the top and one for each side of the tent. The top bead is of a relatively hard plastic while the side beads are of relatively soft rubber. All three beads are installed in the cabinet rail by sliding them into the rail slot from one end until the bead is positioned appropriately within the rail. The top bead is of a relatively hard but flexible plastic, and the bead is securely retained by the rail against any further sliding in the rail or any disengagement from the rail once when the weight of the tent urges the bead downward. The top bead is removed from the cabinet top rail by relieving the weight of the tent from the bead, and then sliding the bead out of the rail.

The side beads are of a soft rubber. They are installed in the cabinet side rails in the same manner as the top bead is installed in the cabinet top rail, that is, by sliding the bead into the slot from one open end of the rail. Because the side beads need not be as securely engaged with the cabinet as the top bead, since they bear much less load than the top bead, the side beads are designed for quick release from the cabinet side rails. This quick release is accomplished by stripping the bead through the slot opening of the rail.

The top and side beads are connected to the body of the tent through top and side tent flaps. The top flap extends from the top bead to the tent top, and the side flaps extend from the side beads to the tent sides. The beads are sewn into one edge of the flaps, and the tent is attached to the opposite edges of the flaps through a zipper. The use of flaps allows a single tent to be used for cabinets of somewhat differing sizes, by simply altering the flap configuration and size.

The use of zippers facilitates the installation of the tent to the cabinet, by allowing the tent beads to be slid into the cabinet rails when the zippers are open to reduce the load of the tent weight on the beads. After the beads are slid into the rails in the desired position, the zippers are closed and the installation is complete.

DETAILED DESCRIPTION OF A PREFERRED EMBODIMENT

Figure 1:
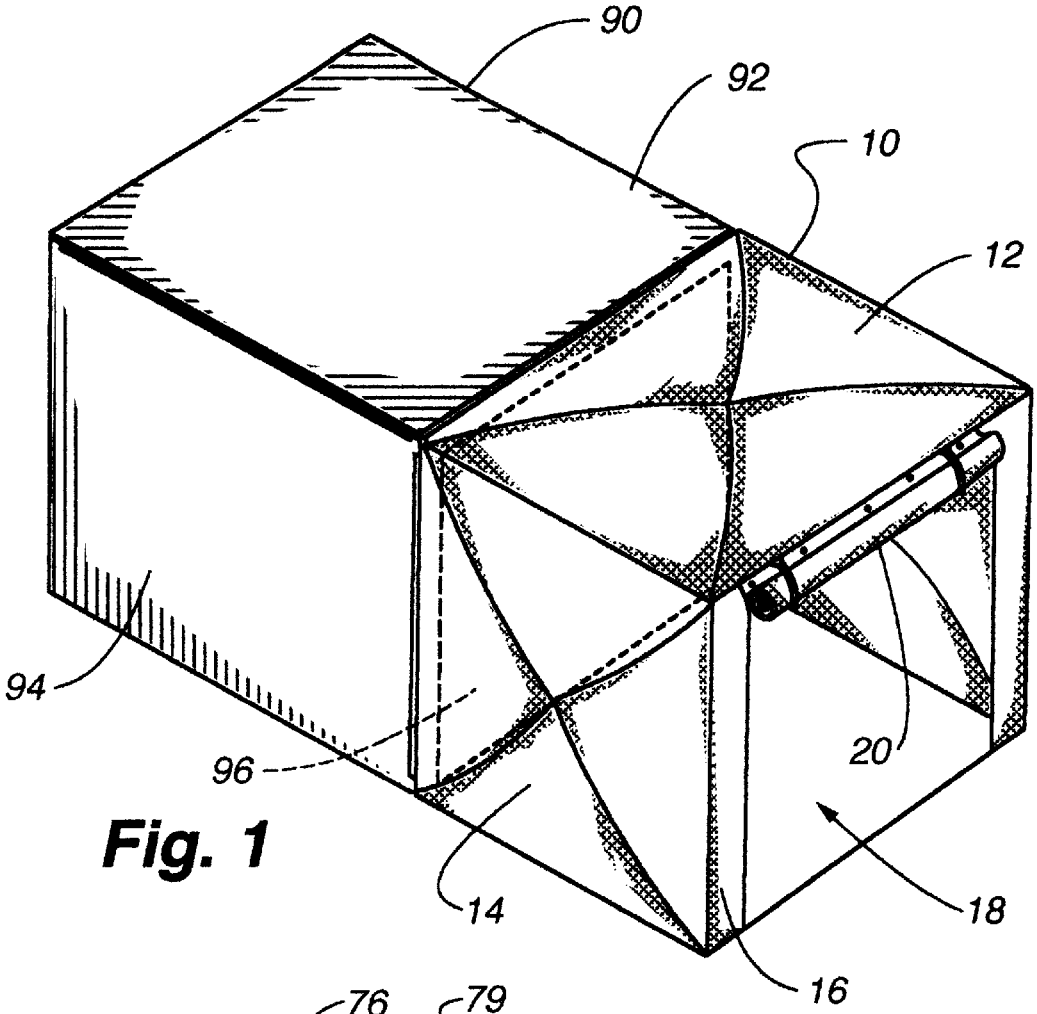
FIG. 1 is a perspective view of a tent in accordance with the present invention attached to a cabinet.

An overall perspective view of a tent 10 in accordance with the present invention is shown in FIG. 1, in combination with a cabinet 90 to which the tent 10 is attached. The cabinet 90 is a common steel or other metal cabinet installed permanently outdoors to house telecommunications or utilities electronic equipment and components. The cabinet 90 includes a top 92, sides 94 and access doors 96 on one end. Cabinets 90 of this type are very well known in the art, and are not described further here except with respect to their interface with the tent 10.

The tent 10 includes tent top 12, tent sides 14 and tent front 16. Tent top 12 is attached to cabinet top 92, and tent sides 14 are attached to cabinet sides 94, in the manner described below. Tent front 16 includes an opening 18 which can be covered by a roll-down access door 20 which is held up when desired by suitable cords or straps (not shown). The tent 10 is of the type with a set of flexible tent poles, which are evident from their imprint on the tent sides 14 and tent top 12 in FIG. 1. The tent poles have one end engaged in a corner of the tent side 14 or tent top 12 and the opposite end engaged in a central hub, there being one hub for each tent side 14 and for the tent top 12. The rectangle defined by this X-shape of tent poles and central hubs is slightly larger than the rectangle defined by the fabric of the tent side 14 or tent top 12. Thus the X-shape defined by the tent poles and central hub must be forcibly biased into position by urging the central hub through an instable intermediate position, so that the central hub is stably biased against the sheet of fabric by the force of the flexible tent poles acting as struts. This arrangement is described in U.S. Pat. No. 3,968,809, assigned to the assignee of the present invention, and is now a well-known and commercially successful tent design. Further details of that system can be found in such patent, which is hereby incorporated by reference.

Figure 3:
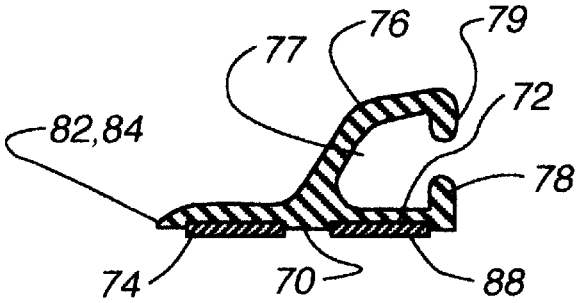
FIG. 3 is a sectional view of a rail for attachment to a cabinet to receive the tent of the present invention.
Figure 2:
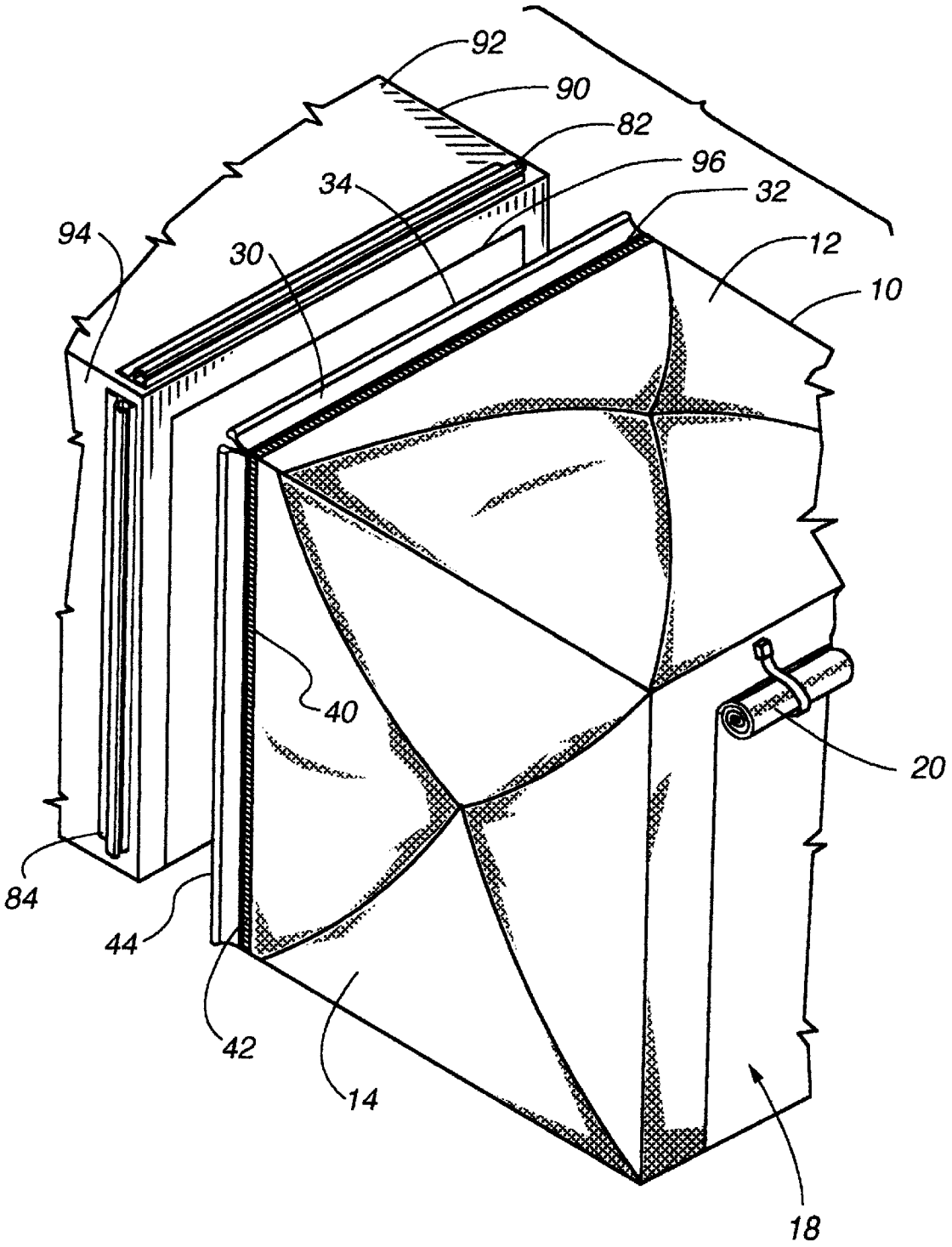
FIG. 2 is a detail perspective view of a tent positioned for attachment to a cabinet.

A detailed perspective view of the interface between the cabinet 90 and tent 10 is shown in FIG. 2. The cabinet 90 top 92 includes top rail 82 mounted thereon at the front edge, and the cabinet 90 sides 94 includes side rails 84 mounted thereon at the front edges. A sectional view of the rails 82 and 84 is depicted in FIG. 3. The rails 82 and 84 include a base 70 having recesses 72 and 74, and an upper portion 76 extending away from base 70. A base lip 78 extends away from base 70 and an upper portion lip 79 extends away from upper portion 76 to define space 77. The base recesses 72 and 74 receive an adhesive for attaching the rails 82, 84 to the cabinet 90. In the preferred embodiment of FIG. 3, the adhesives are double sided adhesive pads 88. In a preferred embodiment, the rails 82 and 84 are aluminum extrusions.

Referring again to FIG. 2, the tent 10 includes upper flap 30 and side flaps 40. The flaps 30 and 40 extend generally away from the tent 10 and toward the cabinet 90. Zippers 32 and 42 attach each flap 30 and 40 at the edges away from the tent 10 to beads 34 and 44 for engagement with the slots 82 and 84 of the cabinet 90.

Figure 4:
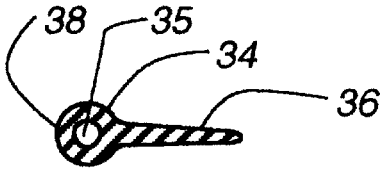
FIG. 4 is a sectional view of a bead element for attachment to a tent and engagement with the rail of FIG. 3.

A sectional view of upper flap bead 34 is shown in FIG. 4. The upper flap bead includes a flange 36 to be sewn to the edge of the fabric upper flap 30 and a bead portion 38 to be received by the slot 82 and having a width greater than the space between the upper portion lip 79 and base lip 78 of the rail 82 in order to be retained in the space 77 of the rail 82 (see FIG. 3). The upper flap bead 34 is preferably of a flexible material that will bend to allow folding and storage of the tent and to facilitate the assembly of the tent 10 but which has sufficient rigidity to prevent material compression and distortion that will allow it to be stripped out of the slot 82. In a preferred embodiment, the upper flap bead is a plastic material. Although the embodiment of FIG. 4 shows a hole 35 in the bead portion 38, such hole 35 is not necessary.

Figure 5:
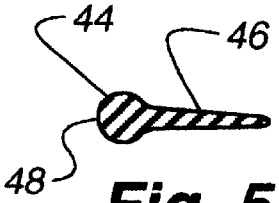
FIG. 5 is a sectional view of another bead element for attachment to a tent and engagement with the rail of FIG. 3.

A sectional view of the side flap bead 44 is shown in FIG. 5. The side flap bead 44 includes a flange 46 to be sewn to the edge of the fabric side flap 40 and a bead portion 48 to be received by the rail 84 and having a width greater than the space between the upper portion lip 79 and base lip 78 of the rail 84 in order to be retained in the space 77 of the rail 84 (see FIG. 3). The side flap bead 44 is preferably of such dimensions and material that it not only can be retained by the side rail 84 while still being sufficiently bendable to allow for folding and storage of the tent and to facilitate the assembly of the tent, but it can also be stripped out of the side rail 84. The side flap bead 44 is thus more compressible and deformable, or is less wide, or both, than the upper flap bead 34 described above.

Figure 6:
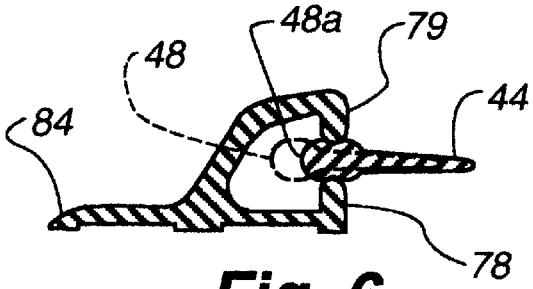
FIG. 6 is a sectional view of the bead of FIG. 5 engaged with and being stripped from the rail of FIG. 3, taken along line 6—6 of FIG. 7.
Figure 7:
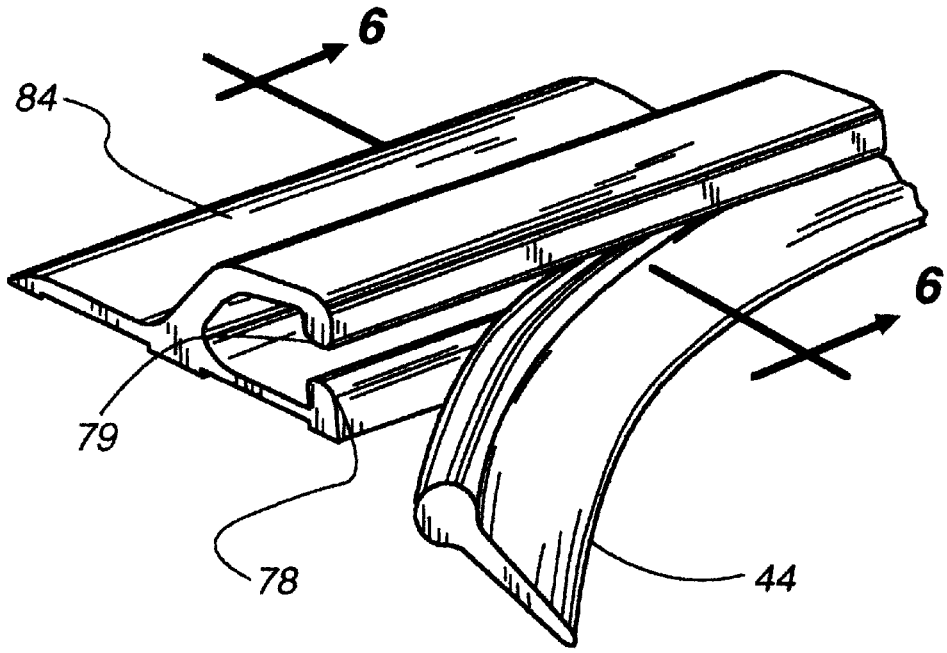
FIG. 7 is a perspective view of the bead of FIG. 5 engaged while being stripped from the rail of FIG. 3.

The stripping of the side flap bead 44 from the side rail 84 is depicted in FIG. 6, wherein the cross-hatched bead portion 48A represents the bead portion 48A being deformed as it passes between the rail upper portion lip 79 and base lip 78, and the non-cross-hatched bead portion 48 is in the background not yet reached by the stripping action. The perspective view of FIG. 7 makes this clearer. The fit is such that the side flap bead 44 can be "stripped" from the side rail 84 in the manner shown, when all the stripping force is concentrated at a single site which advances along the advancing interface between the side flap bead 44 and the side rail 84 as the stripping proceeds. However, the engagement between the side flap bead 44 and the side rail 84 is sufficient that the side flap bead 44 cannot be disengaged from the side rail 84 by an unconcentrated disengagement force applied to the flap 40 in general, as happens by a gust of wind for example.

Figure 8:
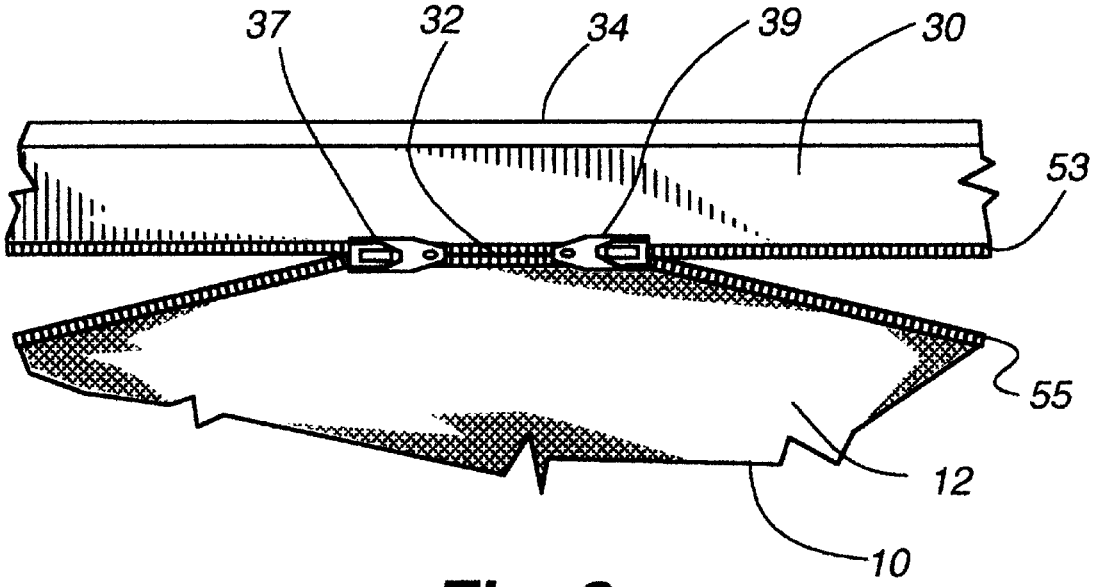
FIG. 8 is a detailed plan view of a zipper used to attach a flap to a side of a tent in accordance with the present invention.

Shown in FIG. 8 is the preferred embodiment of the zippers 32 and 42 which attach the top flap 30 and side flaps 40 to the tent top 12 and tent side 14, respectively. FIG. 8 shows the top flap 30, but it can be appreciated that the side flaps 40 may utilize the same or a similar design. The top zipper 32 includes matching halves 53 and 56 joined by zipper pulls 37 and 39.

An advantage to the zippered flap arrangement taught above is that a small number of tent sizes can serve a large number of cabinet sizes, by simply varying the flap size and configuration. The flaps thus serve as adapters to allow the tent to fit the cabinet. It is not necessary, therefore, to manufacture and inventory a large number of tent sizes to fit the large number of cabinet sizes that are in use. The manufacturer can instead manufacture and inventory a relatively small number of tent sizes, and adapt them to the many cabinet sizes by the use of variously sized flaps.

Next described is the pitching of the tent 10 to engage the cabinet 90. The tent is normally stored in a folded state inside a bag about the size of a duffle bag. The folded tent is removed from the storage bag and unfolded. In the unfolded condition, the tent poles of the top 12 and sides 14 are not yet biased against the tent fabric to produce stable surfaces. The first step before biasing the tent poles is to slide the top flap bead 34 into the cabinet top rail 82. This is accomplished by inserting one end of the top flap bead 34 into one open end of the cabinet top rail 82 and sliding the top flap bead 34 through the cabinet top rail 82 until the top flap 30 is centered in relation to the cabinet.

The two side flaps 40 are then installed, by sliding the lower end of the side flap beads 44 into the open upper end of the cabinet side rails 84. The side flap beads 44 are slid downward into the cabinet side rails 84 until the top of the side flaps 40 match the top of the cabinet 90. The zippers 32 and 42 are closed to secure the flaps 30 and 40 to the body of the tent 10.

The tent is erected in the conventional manner, by biasing central hubs on each side 14 and the top 12 to a stable position against the tent fabric where they are held in place by the force of the strut action of the bent tent poles. The process of erecting a tent of this type is described in some detail in U.S. Pat. No. 3,968,809 the contents of which were incorporated by reference above.

It can be appreciated that the sequence of steps set forth above for the pitching of the tent 10 to the cabinet 90 may be altered. For example, the tent 10 could be pitched prior to the flaps 30 and 40 being attached to the cabinet 90. It is generally desirable, however, that the flaps 30 and 40 be attached to the cabinet 90 via the rails 82 and 84 prior to the zippers 32 and 42 being closed. This is to ensure that there is sufficient looseness in the flaps 30 and 40 to allow the beads 34 and 44 to be started at one end of the rails 82 and 84 and slid through the rails to the desired position.

The tent 10 is taken down and detached from the cabinet 90 in essentially the reverse order. Zipper 32 is opened to allow flap 30 sufficient freedom to slide bead 34 out of rail 82. Side flap beads 44 are stripped from the cabinet side rails 84 in the manner shown in FIGS. 6 and 7. The tent 10 is then taken down in the conventional manner by unbiasing the center hubs of the sides 14 and top 12 from the against the tent fabric, folding the tent to a convenient size, and placing it into the storage bag.

While the tent 10 is pitched and connected to the cabinet 90, the doors 96 of the cabinet 90 can be opened for complete access to the cabinet 90 interior. The interior of the pitched tent 10 is sufficiently roomy for one or more service technicians to stand and work and to hold their equipment. In good weather, the tent 10 serves at least to shade the service technicians. In bad weather, it shelters them, their equipment and the electronic components and equipment housed in the cabinet 90 from rain and snow, from heat and hot sun and from cold. The door 20 can of course be closed over opening 18, and the tent and cabinet interiors can be warmed or cooled with suitable heaters or air conditioners positioned in the interior or positioned outside with air tubes or ducting to the interior.

A significant advantage to the invention that is not immediately apparent from the description above relates to the engagement of the top flap bead 34 with the cabinet top rail 82. The top flap bead 34 freely slides into the cabinet top rail 82 for positioning of the top flap 30 onto the cabinet 90. However, once the top flap bead 34 is properly positioned within the top rail 82 and the top zipper 32 is closed, the weight of the tent 10 is transferred in part through the top flap bead 34 to the cabinet 90. This produces a tightening of the bead portion 38 of the top flap bead 34 in the space between the upper portion lip 79 and base lip 78 of the rail 84 (see FIGS. 6 and 7). This tightening firmly engages the bead 34 with the rail 82 to prevent any sliding or disengagement. In fact, once the top flap bead 34 and top flat 82 receive a significant portion of the weight of the tent 10, the top flap bead 34 becomes essentially immovable in relation to the top rail 82. Upon opening the zippers 32 and 42, however, the weight of the tent 90 is no longer imparted to the bead 34, and the bead 34 can then easily be slid out of rail 82 for detaching the tent 10 from the cabinet 90.

What is claimed:

1. A tent for detachable mounting to a structure, comprising: a top having a top attachment for detachably attaching said top to said structure; and at least one side having a side attachment for detachably attaching said side to said structure; wherein said top attachment includes a top flap extending along and away from an edge of the tent top, said top flap having a top bead for detachable mounting to the structure and said top flap being attached to said top by a zipper.

2. A tent for detachable mounting to a structure, comprising: a top having a top attachment for detachably attaching said top to said structure; and at least one side having a side attachment for detachably attaching said side to said structure; wherein said top attachment includes a top flap extending along and away from an edge of the tent top, said side attachment includes a side flap extending along and away from an edge of the tent side, and said side attachment includes a side bead attached to said side flap for detachable mounting to the structure and said side flap being attached to the side by a zipper.

3. A shelter for detachable engagement with a substantially rigid structure having a front with a door therein, a top slotted element above the door, and a side slotted element to a side of the door; said shelter having:

a top with a top flap containing a top bead extending along a top edge for detachable engagement with the structure top slotted element, and a side with a side flap containing a side bead extending along a side edge for detachable engagement with the structure side slotted element, said engagement of the top and side beads with the slotted elements serving to position the shelter in front of the structure's door, wherein the top flap includes a zipper extending substantially parallel to the top bead, and the side flap includes a zipper extending substantially parallel to the side bead.

4. A method of attaching a tent to a structure, comprising:

attaching a tent top attachment connected to the tent top to the top of the structure including sliding a tent top bead on the tent top attachment through a slotted element on the top of the structure, attaching a tent side attachment connected to a tent side to the side of the structure including sliding a tent side bead on the tent side attachment through a slotted element on the side of the structure and substantially sealing the tent to the top and side attachments by closing a top zipper connecting the top attachment to the top of the tent and closing a side zipper connecting the side attachment to the side of the tent.

* * * * *